US007031817B2

(12) United States Patent
Kim

(10) Patent No.: US 7,031,817 B2
(45) Date of Patent: Apr. 18, 2006

(54) SAFETY SECURING SYSTEM FOR OPERATION LEVER OF CONSTRUCTION VEHICLE

(75) Inventor: Jin Seob Kim, Changwon (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 92 days.

(21) Appl. No.: 10/878,133

(22) Filed: Jun. 25, 2004

(65) Prior Publication Data

US 2005/0209758 A1 Sep. 22, 2005

(30) Foreign Application Priority Data

Mar. 22, 2004 (KR) ..... 10-2004-0019257

(51) Int. Cl.
*E02F 9/24* (2006.01)
*F15B 20/00* (2006.01)
*G06F 7/70* (2006.01)

(52) U.S. Cl. ..... 701/50; 340/438

(58) Field of Classification Search ..... None
See application file for complete search history.

(56) References Cited

U.S. PATENT DOCUMENTS 4,059,196 A * 11/1977 Uchino et al. ..... 414/699
5,547,039 A * 8/1996 Berger et al. ..... 180/287
5,999,872 A * 12/1999 Kinugawa et al. ..... 701/50
6,735,889 B1 * 5/2004 Berger et al. ..... 37/348
2003/0149518 A1 8/2003 Brandt et al.

FOREIGN PATENT DOCUMENTS

| | | |
|---|---|---|
| EP | 0 553 348 | 8/1993 |
| JP | 7-11674 | 1/1995 |
| JP | 2000-136551 | 5/2000 |
| JP | 2001-41069 | 2/2001 |
| JP | 2004-036343 * | 2/2004 |

OTHER PUBLICATIONS

Patent Abstracts of Japan of JP 2001-41069 dated Feb. 13, 2001.
Patent Abstracts of Japan of JP 2000-136551 dated May 16, 2000.
Patent Abstracts of Japan of JP 7-11674 dated Jan. 13, 1995.

* cited by examiner

*Primary Examiner*—Michael J. Zanelli
(74) *Attorney, Agent, or Firm*—Ladas & Parry LLP

(57) ABSTRACT

The present invention relates to a safety securing system for an operation lever through which work equipment does not operate unexpectedly or suddenly. The safety securing system includes a receiver for receiving a detection signal from an engine rpm detector detecting the engine shaft rpm, a control input detector of the operation lever, and a safety lever position detector, respectively; a data processor for deciding whether the engine starts, whether the operation lever is in the neutral position, and whether the safety lever is in operation; and an output for outputting an engine stop signal, an alarm signal, and a driving signal according to the control input of the operation lever.

2 Claims, 2 Drawing Sheets

SAFETY SECURING SYSTEM FOR OPERATION LEVER OF CONSTRUCTION VEHICLE

BACKGROUND OF THE INVENTION

1. Field of the Invention

The present invention relates in general to a safety securing system for an operation lever, and more particularly, to a safety securing system for preventing the operation of work equipments at the release of a security lever while an operation lever for controlling the construction machine of a construction vehicle is in operation.

2. Description of the Related Art

In general, a construction vehicle including an excavator has an operational lever like a joystick or a driving pedal. The joystick is used to operate working tools such as boom, arm, bucket, and swing unit. The driving pedal is used to accelerate the vehicle.

Hydraulic pressure from an engine-driven hydraulic pump is a driving power source of operations of the work equipment, the swing equipment, and the driving equipment. A controller controls every kind of control valves according to the control input (manipulated variable) of the operation lever and basically controls hydraulic pressure supplied to the work equipment and direction and flow of hydraulic fluid to operate the work equipment.

For instance, the excavator is heavy, massive construction equipment and is operated by hydraulic pressure, so it is very important to secure the safety during work. Usually, a safety lever is used to prevent the work equipment from operating unexpectedly. In a way to secure the safety, therefore, the work equipment operates only when the safety lever is released, and if the safety lever is locked out during the operation of the work equipment, the operation lever stops working and all work equipments also stop their operation.

However, if the safety lever is released when the operation lever is still in operation, there is always a possibility that the work equipment might operate at the same time of the release of the safety lever. In other words, although the safety lever is supposed to stop the work equipment during emergency and functions as a safety securing system, ensuring the work equipment to stop operation, it does not have a function of preventing the malfunction of the equipment when the safety lever is released with the operation lever being in operation.

As an attempt to solve the above problem, there was a technique for determining an operational state of the operation lever on the basis of a signal from a pressure sensor connected to the hydraulic fluid line of the operation lever, and stopping the engine of the excavator if the operation lever is in operation before the engine starts.

According to this technique, even though the operation lever is in operation while the safety lever is released, a controller, after determining the state of the operation lever, is capable of making the engine stop. Therefore, the mechanic malfunction where the work equipment suddenly starts operating as soon as the engine starts running does not occur any more. However, if a driver accidentally released the safety lever while the operation lever had been in operation after the engine started running, there is always a possibility that the work equipment would operate all of a sudden, causing an accident.

SUMMARY OF THE INVENTION

It is, therefore, an object of the present invention to provide a safety securing system for an operation lever of a construction vehicle, ensuring that work equipment does not suddenly start operating at a time of releasing a security lever before and after an engine starts running, thereby improving the safety of the construction vehicle.

To achieve the above object, there is provided a safety securing system for an operation lever of a construction vehicle, in which work equipment is allowed to operate after checking whether the engine is running, whether the operation lever is in the neutral position, and whether the safety lever is in operation.

One aspect of the invention provides a safety securing system for an operation lever of a construction vehicle, in which the construction vehicle includes a plurality of work equipments, each being driven by a hydraulic pump operated by an engine, an operation lever for generating a driving signal for the work equipments, and a safety lever for stopping the operation lever when the safety lever is locked out, the safety securing system including: a receiver for receiving a detection signal from an engine rpm detector detecting the engine shaft rpm, a control input detector of the operation lever, and a safety lever position detector, respectively; a data processor for deciding, on the basis of the signal received to the receiver, whether the engine starts, whether the operation lever is in the neutral position, and whether the safety lever is in operation, making a decision on whether to operate the work equipment, and memorizing, through a neutral position check bit mounted in the data processor, whether the decision on the position of the operation lever is made; and an output for outputting, based on the result of process of the data processor, an engine stop signal, an alarm signal, and a driving signal outside according to the operation lever's control input.

Preferably, if the operation lever is not in the neutral position while the engine stops running, the safety securing system for the operation lever outputs an engine stop signal and an alarm signal; if the safety lever is in operation when the engine starts, the safety securing system turns off the neutral position check bit; if the engine starts and the security lever is released and the neutral position check bit is turned off, the safety securing system outputs an engine stop signal and an alarm message provided that the operation lever is not in the neutral position, and the safety securing system changes the value of the neutral position check bit to 'on' provided that the operation lever is in the neutral position; and if the engine starts and the security lever is released and the neutral position check bit is 'on', the safety securing system outputs a driving signal according to the control input of the operation lever provided that a signal from the operation lever is normal, and the safety securing system outputs an alarm message provided that a signal from the operation lever is abnormal.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
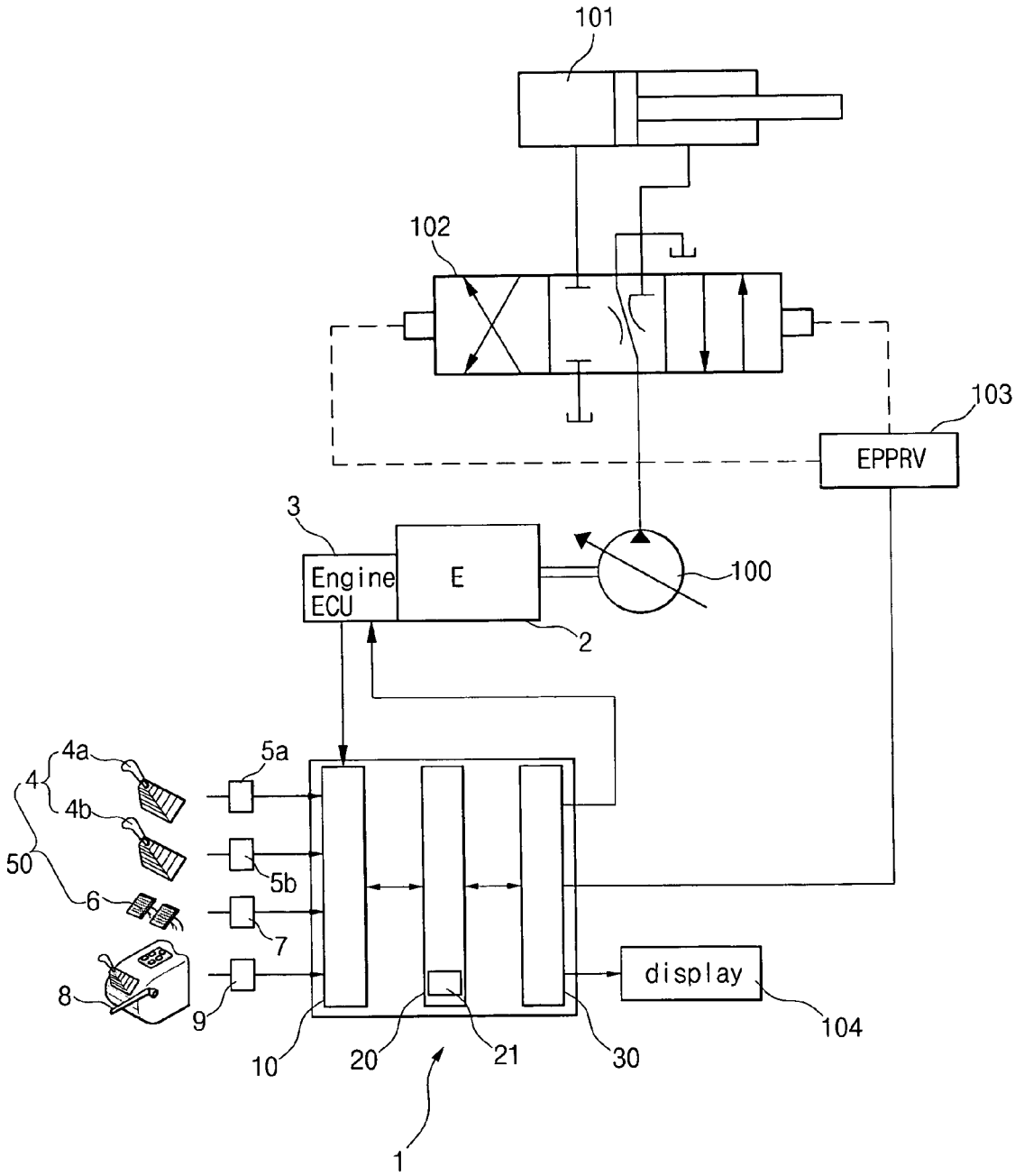
FIG. 1 is a schematic diagram of a safety securing system for an operation lever according to one embodiment of the present invention.

FIG. 1 illustrates the structure of a safety securing system for an operation lever according to one embodiment of the present invention. As shown in FIG. 1, major components of an excavator including the safety securing system 1 are interconnected to each other.

Referring to FIG. 1, the excavator includes a hydraulic pump 100 operating by an engine 2, a plurality of work equipments 101 driving by the hydraulic pump 100, a directional control valve 102 for supplying hydraulic fluid from the hydraulic pump 100 to the work equipment 101, joystick 4 and driving pedal 6 for generating a driving signal for the work equipment 101, a safety lever 8, and a safety securing system for an operation lever 1.

Hereinafter, the joystick 4 and the driving pedal 6 will be called as the operation lever 50.

The safety securing system for the operation lever 1 according to one embodiment of the present invention includes a receiver 10, a data processor 20, and an output 30. The receiver 10 receives every kind of signal, the data processor 20 processes received signals to the receiver 10, and the output 30 outputs a signal outside in response to a processed signal.

More specifically, the receiver 10 receives a signal from an engine rpm detector (not shown) for detecting an engine shaft's rpm, control input detectors 5*a*, 5*b*, and 7 of the operation lever 50, and a safety lever position detector 9, respectively. The engine rpm detector (although it is not illustrated in the drawing) is housed in an engine ECU and detects the engine shaft's rpm, and a detected signal is transferred from the engine ECU to the receiver 10.

The control input detectors 5*a*, 5*b*, and 7 of the operation lever 50 are connected to the joysticks 4*a* and 4*b* and the driving pedal 6, respectively, and outputs detected control input of the operation lever 50 as a signal and transfers the signal to the receiver 10. Also, the safety lever position detector 9 is connected to the safety lever 8 and transfers to the receiver 10 a signal indicating whether the safety lever 8 is released or locked out.

The data processor 20, on the basis of the signal received to the receiver 10, decides whether the engine 2 is running, whether the operation lever 50 is in the neutral position, and whether the safety lever 8 is in operation, and then determines whether the work equipment 101 should be operated. In addition, the data processor 20 includes a neutral position check bit 21 that memorizes the existence of the decision on whether the operation lever 50 is in the neutral position. Therefore, the data processor 20 can check more effectively the situation where the safety lever 8 is released wile the operational lever 50 is in operation, given that the engine 2 has started.

The output 30 stops, according to the result of the process through the data processor 20, stops the engine 2 by transferring an engine stop signal to the engine ECU 3, or transfers an alarm signal to a display device 104, or outputs to an electronic control valve 103 a driving signal according to the control input of the operation lever 50.

Figure 2:
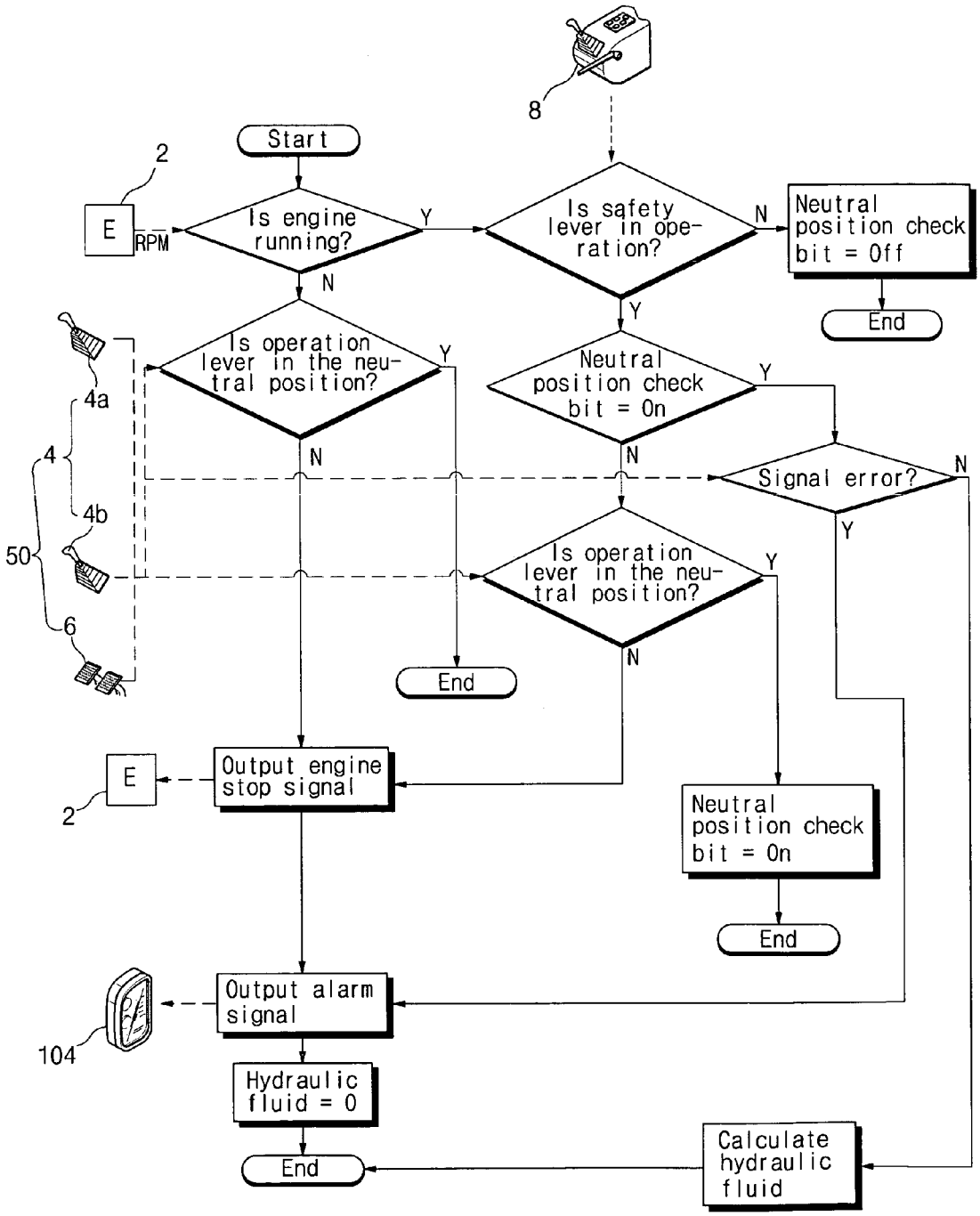
FIG. 2 illustrates a control flow chart describing an operational state of a safety securing system for an operation lever according to one embodiment of the present invention.

FIG. 2 illustrates a control flow chart describing an operational state of the safety securing system for the operation lever according to one embodiment of the present invention. The following will now provide details on the operational state of the safety securing system for the operation lever 1 with reference to FIG. 2.

The control flow of the safety securing system 1 indicates that the operational states of the system 1 are different, depending on whether or not the engine 2 has started at the same time with the system 1. That is, the operation of the safety securing system 1 is divided into two: before and after the engine 2 starts.

A) Before the Engine Starts:

When the engine 2 has stopped, the safety securing system 1 decides whether the operation lever 50 is in the neutral position, and if it turns out that the operation lever 50 is not in the neutral position, the safety securing system 1 outputs an engine stop signal and an alarm signal. Therefore, in the case that the operation lever 50 is not in the neutral position, the engine stop signal is inputted to the engine ECU 3 and the engine would not start. In this way, the malfunction of the operation lever 50 does not occur.

B) After the Engine Starts:

1) When the Safety Lever is Locked Out;

If the engine 2 is running, the data processor 20 of the safety securing system 1 decides whether or not the safety lever 8 is in operation. If the safety lever 8 is in operation or is locked out, the data processor 20 turns off the neutral position check bit 21 so the neutral position check bit 21 memorizes the fact that the system 1 has not yet decided whether the operation lever 50 was in the neutral position, and this ends the operation of the system 1.

2) When the Safety Lever is Released;

If the safety lever 8 is released while the engine 2 is running, the safety securing system 1 first decides a value stored in the neutral position check bit 21. If value of the neutral position check bit 21 is 'off', it means that decision has not made on whether the operation lever 50 was in the neutral position. Thus, the system 1 now decides whether the operation lever 50 is in the neutral position.

If the operation lever 50 is in the neutral position, the system 1 changes the value of the neutral position check bit 21 to 'on', and allows the neutral position check bit 21 to memorize the fact that the system 1 has decided whether the operation lever 50 was in the neutral position, and then the operation of the system 10 ends. However, if the operation lever 50 is not in the neutral position and is in operation instead, the system 1 outputs an engine stop signal or an alarm message because the work equipment 101 should not be running in this case. Further, the system 1 outputs a driving signal for making the hydraulic fluid value '0', and ends the operation.

If the value of the neutral position check bit 21 is 'on', this means that the system 1 has already decided whether the operation lever 50 was in the neutral position. Therefore, there is no need to decide again whether the operation lever 50 is in the neutral position. Instead, the system 1 decides whether an electric signal inputted from the operation lever 50 is abnormal due to breaking of wire or noise. If the signal turns out to be normal, the system 1 calculates hydraulic fluid according to the control input and outputs a corresponding driving signal. However, if the signal turns out to be abnormal, the system 1 outputs an alarm message and a driving signal for making the hydraulic fluid value '0', and ends the operation.

As described above, if the safety lever 8 is locked out while the engine 2 is running, the system 1 turns off the neutral position check bit 21. Also, if the safety lever 8 is released while the engine 2 is running, the system 1 first decides the value of the neutral position check bit 21 before driving the work equipment 101. This is because the safety of the system 1 should be secured when the safety lever 8 is released.

In the case that the operation lever 50 is in the neutral position when the safety lever 8 is released, the system 1 changes the value of the neutral position check bit 21 to 'on'.

This is because when the safety lever 8 changes its state from being locked out to being released, the system 1 checks only once whether the operation lever 50 is in the neutral position and then outputs a driving signal according to the control input of the operation lever 50, so that the system 1 does not need to check the position of the operation lever 50 again but only checks whether the signal from the operation lever 50 is normal.

As shown in the control flow chart in FIG. 2, the safety securing system 1 for the operation lever decides whether the engine started, whether the operation lever is in the neutral position, and whether the safety lever is in operation. In so doing, the system 1 ensures that the work equipment 101 does not operate unexpectedly not only when the engine 2 starts but also when the engine 2 is already running, or when the safety lever 8 is released with the operation lever 50 being in operation.

In conclusion, the safety securing system for the operation lever according to the present invention can be advantageously used for improving the safety of the construction vehicle, by checking whether the operation lever is in the neutral position as the safety lever is released before and after the engine starts and making a decision on whether the work equipment should be operated, so that the work equipment does not operate unexpectedly or suddenly.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A safety securing system for an operation lever of a construction vehicle, in which the construction vehicle includes a plurality of work equipments, each being driven by a hydraulic pump operating by an engine, an operation lever for generating a driving signal for the work equipments, and a safety lever for stopping the operation lever when the safety lever is locked out, the safety securing system comprising:

a receiver for receiving a detection signal from an engine rpm detector detecting the engine shaft rpm, a control input detector of the operation lever, and a safety lever position detector, respectively;

a data processor for deciding, on the basis of the signals received by the receiver, whether the engine starts, whether the operation lever is in the neutral position, and whether the safety lever is in operation, making a decision on whether to operate the work equipment, and memorizing, through a neutral position check bit of the data processor, whether the decision on the position of the operation lever is made; and an output for outputting, based on the result of process of the data processor, an engine stop signal, an alarm signal, and a driving signal outside according to the operation lever's control input.

2. The system according to claim 1, wherein if the operation lever is not in the neutral position while the engine stops running, the safety securing system for the operation lever outputs an engine stop signal and an alarm signal; if the safety lever is in operation when the engine starts, the safety securing system turns off the neutral position check bit; if the engine starts and the security lever is released and the neutral position check bit is turned off, the safety securing system outputs an engine stop signal and an alarm message provided that the operation lever is not in the neutral position, and the safety securing system changes the value of the neutral position check bit to 'on' provided that the operation lever is in the neutral position; and if the engine starts and the security lever is released and the neutral position check bit is 'on', the safety securing system outputs a driving signal according to the control input of the operation lever provided that a signal from the operation lever is normal, and the safety securing system outputs an alarm message provided that a signal from the operation lever is abnormal.

* * * * *